United States Patent [19]

Schnell et al.

[11] Patent Number: 4,737,100

[45] Date of Patent: Apr. 12, 1988

[54] DUCT BURNER APPARATUS

[75] Inventors: Earl W. Schnell, Broken Arrow; Hershel E. Goodnight, Tulsa; Dale A. Nickeson; Richard T. Waibel, both of Broken Arrow, all of Okla.

[73] Assignee: John Zink Company, Tulsa, Okla.

[21] Appl. No.: 857,938

[22] Filed: Apr. 30, 1986

[51] Int. Cl.[4] ..... F23T 9/00; F23D 14/76

[52] U.S. Cl. ..... 431/3; 431/350; 239/288; 239/550; 432/222

[58] Field of Search ..... 431/350, 351, 3; 432/222; 239/103, 104, 288, 566, 550

[56] References Cited

U.S. PATENT DOCUMENTS

| | | | |
|---|---|---|---|
| 1,532,612 | 4/1925 | Taylor | 431/350 |
| 3,178,161 | 4/1965 | Yeo et al. | 263/19 |
| 3,366,373 | 1/1968 | Reed | 263/19 |
| 3,574,507 | 4/1971 | Kydd | 431/350 |
| 3,587,232 | 6/1971 | Bryce | 60/39 |
| 3,592,578 | 7/1971 | Weatherston | 431/278 |
| 3,632,286 | 1/1972 | Kegan et al. | 431/284 |
| 3,649,211 | 3/1972 | Vosper | 23/277 C |
| 3,682,451 | 8/1972 | Vosper | 263/19 A |
| 3,732,059 | 5/1973 | Goodnight et al. | 431/286 |
| 3,739,989 | 6/1973 | Vosper | 239/399 |
| 3,843,309 | 10/1974 | Lambiris | 431/284 |
| 4,286,945 | 9/1981 | Vosper et al. | 432/29 |
| 4,375,952 | 3/1983 | Vosper et al. | 431/171 |
| 4,523,905 | 6/1985 | Lewis | 431/351 |
| 4,548,577 | 10/1985 | McGill | 431/202 |
| 4,573,907 | 3/1986 | Coppin et al. | 431/351 |

*Primary Examiner*—Samuel Scott
*Assistant Examiner*—Allen J. Flanigan
*Attorney, Agent, or Firm*—Laney, Dougherty, Hessin & Beavers

[57] ABSTRACT

A duct burner apparatus and method for burning a gaseous fuel in the presence of a flowing oxygen-containing gas stream is provided. The apparatus comprises fuel gas supply means positioned in the path of the oxygen-containing gas stream and at least one elongated baffle means spaced from the conduit means on the downstream side thereof. The baffle means includes an inner wall portion and diverging outer wing portions and defines an ignition zone which is shielded from the conduit means. Spacer means for supporting the baffle means are attached thereto and to the conduit means, and fuel gas nozzle means are removably connected to the conduit means which extend to the baffle means for introducing fuel gas into the ignition zone and downstream thereof.

16 Claims, 3 Drawing Sheets

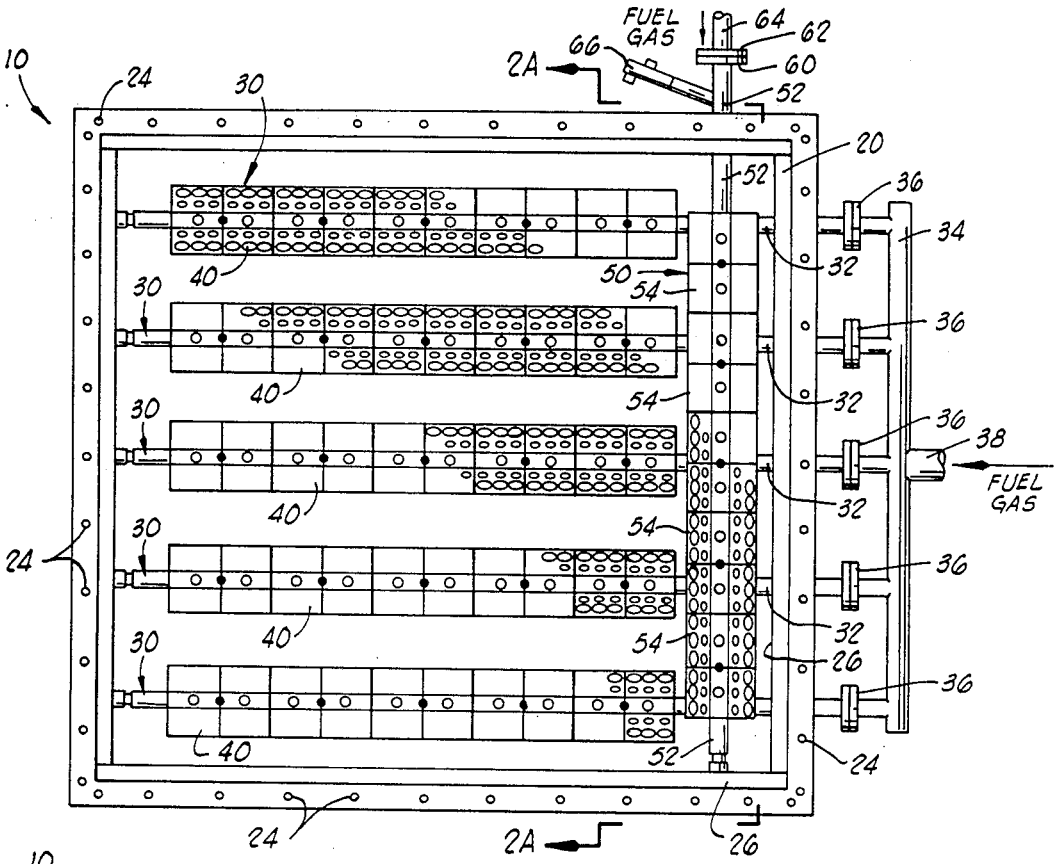
FIG. 1A
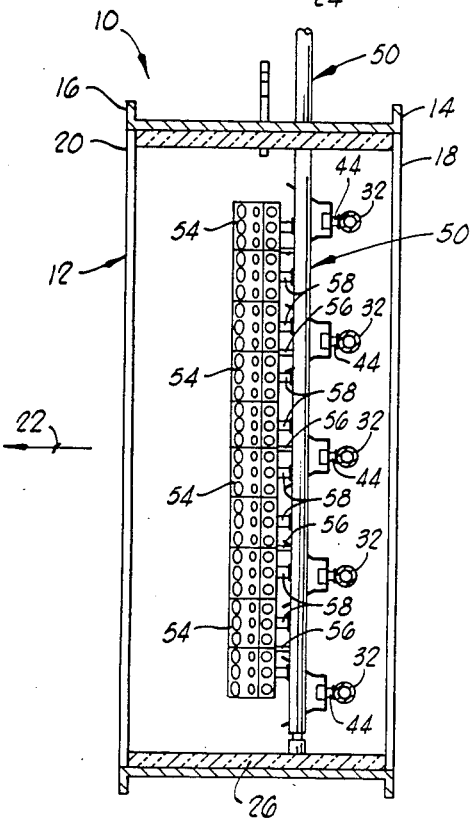
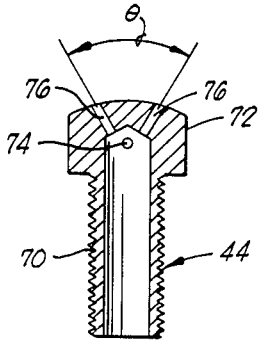
FIG. 8
FIG. 2A

DUCT BURNER APPARATUS

BACKGROUND OF THE INVENTION

1. Field of the Invention

The present invention relates generally to improved duct burner apparatus and method, and more particularly, to improved burner apparatus and method for burning a gaseous fuel in the presence of a flowing oxygen-containing gas stream.

2. Description of the Prior Art

A variety of apparatus for burning a gaseous fuel in the presence of a flowing gas stream, i.e., duct burner apparatus, have been developed and utilized heretofore. Such apparatus are most often utilized in applications where it is advantageous or necessary to add heat to a previously heated oxygen-containing gas stream. For example, the temperature of the hot oxygen-containing gases discharged from a gas turbine is in the range of from about 800° F. to 1200° F. In order to prevent the waste of the heat contained in such turbine exhaust gases, they are often utilized for further process heating. Adding heat to the exhaust gases by means of duct burner apparatus prior to utilizing the gases in process heating applications offers improved heat recovery efficiency with minimum mechanical components. U.S. Pat. No. 3,366,373 issued Jan. 30, 1968 discloses burner apparatus for adding heat to gas turbine exhaust gases flowing through a duct whereby the heated gases can be utilized for producing steam in waste heat boiler or the like.

Various duct burners and duct burner assemblies have been developed which include a fuel gas supply conduit or system of conduits positioned in the path of a flowing oxygen-containing gas stream to be heated. Fuel discharge ports for introducing fuel gas into the oxygen-containing gas stream are disposed in the conduit or conduits and baffle means are attached to the conduit or conduits for providing a relatively quiescent fuel gas ignition zone whereby combustion takes place within and downstream stream of the zone. Examples of such burners and burner assemblies or systems are shown in U.S. Pat. Nos. 3,574,507 issued Apr. 13, 1971; 3,732,059 issued May 8, 1973; 3,843,309 issued Oct. 22. 1974; and 4,523,905 issued June 18, 1985.

While the duct burners and duct burner assemblies utilized heretofore have achieved varying degrees of success, they all suffer from certain disadvantages which affect their operation and service lives. The most severe such disadvantage is the warpage and resultant deterioration of the fuel gas supply conduits and baffles attached thereto as a result of uneven heating from radiation and/or flame impingement. That is, in prior duct burner apparatus, the arrangement of fuel gas supply conduit and baffles for defining a flame holding ignition zone has been such that the combustion of the fuel gas takes place in close proximity to one side of the fuel gas conduit. The resulting radiation and/or flame impingement on that side of the conduit causes the conduit to be unevenly heated which sets up stresses therein and results in warpage and rapid deterioration.

Another disadvatange in prior duct burner apparatus is that the fuel gas is often discharged through fixed fuel gas discharge ports disposed in the fuel gas supply conduit. As a result, the ports cannot be changed or cleaned without involving a major equipment removal and replacement operation. Other disadvantages include long flame length, poor turn down, i.e., inefficient combustion at low fuel gas rates, poor heat distribution into the gas stream being heated and high emissions of atmosphere polluting compounds.

By the present invention, an improved duct burner apparatus and assembly for burning a gaseous fuel in the presence of a flowing oxygen-containing gas stream are provided with obviate the disadvantages mentioned above.

SUMMARY OF THE INVENTION

A duct burner apparatus, method and assembly for burning gaseous fuel in the presence of flowing oxygen-containing gas streams are provided. The burner apparatus is comprised of fuel gas supply conduit means positioned in the path of a flowing oxygen-containing gas stream and an elongated baffle means which includes an inner wall portion and outer wing portions spaced from the conduit means on the downstream side thereof. The baffle means define a fuel gas ignition zone which is shielded from the conduit means, and the wing portions thereof have openings therein for the passage of oxygen-containing gas into the zone. Spacer means for supporting the baffle means are connected between the baffle means and the conduit means, and fuel gas nozzle means are connected to the conduit means which extend to a position adjacent the baffle means for introducing fuel gas into the ignition zone and into the oxygen-containing gas stream.

It is, therefore, a general object of the present invention to provide an improved duct burner apparatus and method for burning a gaseous fuel in the presence of a flowing oxygen-containing gas stream.

A further object of the present invention is the provision of duct burner apparatus and method wherein uneven heating of the fuel gas supply conduit means as a result of flame impingement and/or radiation heating and the warpage attendant thereto are substantially eliminated.

Another object of the present invention is the provision of an improved duct burner apparatus which includes removable fuel gas discharge nozzles which can be easily cleaned or changed in the field to meet changes in fuel gas operating conditions.

Yet another object of the present invention is the provision of an improved duct burner apparatus and method which provides high turn down, short flame lengths, efficient heat distribution to the gas stream being heated and low atmosphere pollutant emissions.

Other and further objects, features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIG. 1A is a side elevational view of an alternate duct burner apparatus assembly of the present invention.

FIG. 2A is a cross-sectional view taken line 2A—2A of FIG. 1A.

FIG. 8 is a cross-sectional view taken along line 8—8 of FIG. 7.

DESCRIPTION OF PREFERRED EMBODIMENTS

Figure 1:
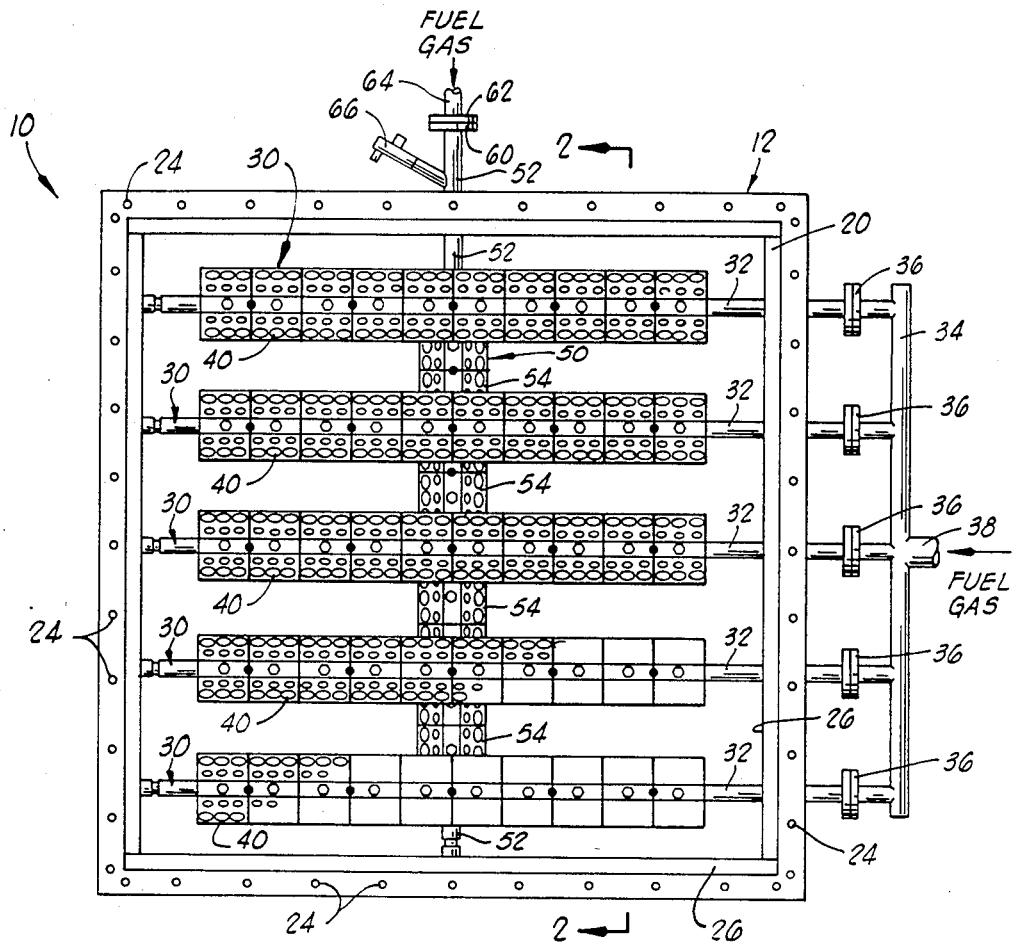
FIG. 1 is a side elevational view of a duct burner apparatus assembly of the present invention.
Figure 2:
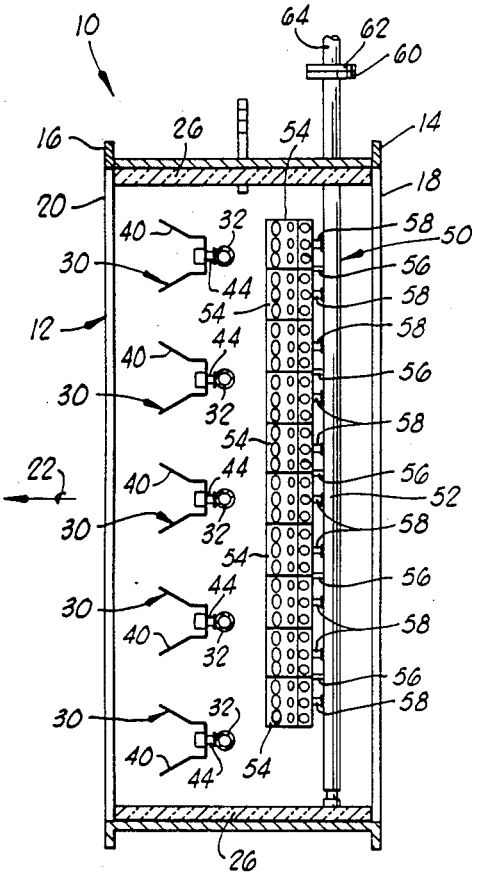
FIG. 2 is a cross-sectional view taken along line 2—2 of FIG. 1.

Referring now to the drawings, and particularly to FIGS. 1 and 2, a duct burner apparatus assembly of the present invention, generally designated by the numeral 10, is illustrated.

The assembly 10 is comprised of a housing 12 adapted to be sealingly connected to a duct whereby an oxygen-containing gas stream to be heated flows therethrough. While the housing 12 can be of any convenient size and shape, it normally is of rectangular shape, and includes a pair of rectangular flanges 14 and 16 attached to the ends 18 and 20 thereof, respectively. The housing 12 is positioned with respect to the duct to which it is attached (not shown) whereby the oxygen-containing gas stream flows through the housing 12 from the upstream end 18 thereof to the downstream end 20 thereof, i.e., the gas stream flows in the direction indicated by the arrow 22 of FIG. 2. Each of the flanges 14 and 16 includes a plurality of spaced openings 24 therein for accommodating bolts used to sealingly attach the flanges 14 and 16 to complemenetary flanges attached to the duct, and the internal surfaces of the bottom, top and sides of the housing 12 are insulated with suitable heat insulating materials 26.

Disposed within the housing 12 and supported or guided on opposite sides thereof are a plurality of elongated duct burners, generally designated by the numeral 30. Each of the burners 30 includes an elongated fuel gas supply conduit 32, one end of which extends through a side of the housing 12 and is connected to a fuel gas inlet manifold 34 by a conventional flange connection 36. The manifold 34 is in turn connected to a source of fuel gas by a conduit 38 connected thereto. The ends of the elongated fuel gas supply conduits 32 opposite from the ends thereof connected to the fuel gas manifold 34 are closed and are attached to the side of the housing 12 in a convenient manner.

The conduits 32 can be positioned either horizontally, vertically or otherwise, but preferably in spaced relationship within the housing 12 with the axes thereof substantially parallel to each other. In addition, the axes of the conduits 32 all preferably lie in a plane which is substantially perpendicular to the direction of flow of the oxygen-containing gas stream through the housing 12. Positioned downstream of each of the fuel gas supply conduits 32 on a line substantially parallel to the axis thereof are a plurality of elongated perforated angular baffles 40. The baffles 40, which will be described in detail hereinbelow, define gas ignition zones downstream from the conduits 32 which are shielded from the conduits 32. The baffles 40 are supported in their downstream positions by spacers 42 connected between the baffles 40 and the conduits 32.

A plurality of elongated fuel gas nozzles 44 are threadedly connected to openings in and are spaced along each fuel gas supply conduit 32. The downstream ends of the nozzles 44 extend through openings 46 in the baffles 40 whereby fuel gas discharged therefrom is discharged on the downstream side of the baffles 40 into the gas combustion ignition zone defined thereby.

In the embodiment illustrated in FIGS. 1 and 2, a single ignition burner 50, which is similar to the burners 30, is positioned upstream of the burners 30. Like the burners 30, the burner 50 includes an elongated fuel gas supply conduit 52 connected to a plurality of downstream perforated baffles 54 positioned on a line substantially parallel to the axis of the conduit by a plurality of spacers 56 attached therebetween. A plurality of fuel gas nozzles 58 are threadedly connected to openings in and are spaced along the conduit 52, each of which extends through an opening in a baffler 54 to a position downstream thereof. The axis of the fuel gas supply conduit 52 of the ignition burner 50 can be positioned in the middle as shown or on either side of the housing 12. Preferably, as shown, the ignition burner 50 is positioned on a line substantially perpendicular to the axes of the fuel gas supply conduits 32 of the burners 30. The lower closed end of the conduit 52 is attached to the bottom of the housing 12 and the upper end thereof sealingly extends through the top of the housing 12 and terminates in a flange connection 60. The flange connection 60 is attached to a complementary flange connection 62 which is in turn connected to a conduit 64. The conduit 64 conducts fuel gas to the ignition burner 50 from a source thereof. A conventional fuel gas ignitor means 66 for igniting fuel gas flowing through the fuel gas supply conduit 52 of the burner 50 is connected to the conduit 52.

Other arrangements of the ignition burner 50 can be utilized. For example, as shown in FIGS. 1A and 2A, the ignition burner 50 can be positioned in front and to one side of the burners 30. Also, in some applications the ignition burner 50 can be omitted altogether and individual ignitor means can be utilized at one or both ends of each of the burners 30.

In operation of the burner assembly 10 for adding heat to the oxygen-containing gas stream flowing therethrough, fuel gas is first caused to flow to the ignition burner 50 by way of the fuel gas supply conduit 52 thereof. The fuel gas flows through the conduit 52, through the discharge nozzles 58 connected thereto and is discharged from the nozzles 58 within and downstream of the ignition zone defined by the baffles 54 positioned on the downstream side of the conduit 52. The fuel gas discharged from the burner 50 is ignited by the ignitor means 66 attached to the conduit 52. Fuel gas is next caused to be supplied to the manifold 34 and to the fuel gas supply conduits 32 of the burners 30 whereby fuel gas is discharged from the nozzles 44 connected to the conduits 32 into the downstream of the ignition zones defined by the baffles 40 connected to the conduits 32. The fuel gas discharged from the burners 30 is ignited by the burning gases discharged from the ignition burner 50. Upon such ignition, the fuel gas supplied to the burner 60 can optionally be shut off. The burning of the fuel gas discharged from the burners 30 within the housing 12 causes the oxygen-containing gas stream flowing therethrough to be substantially uniformly heated.

Figure 3:
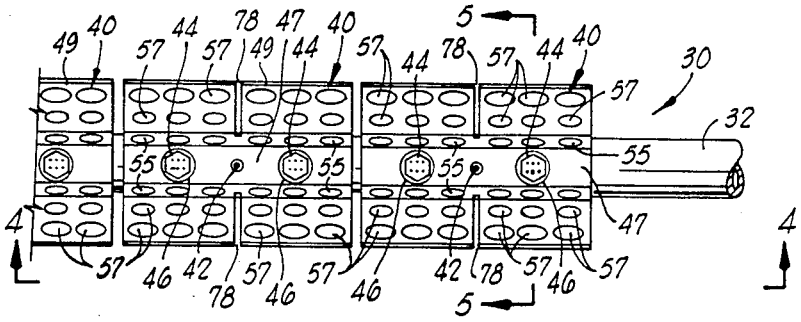
FIG. 3 is an enlarged partial view of a portion of the apparatus of FIG. 1.
Figure 5:
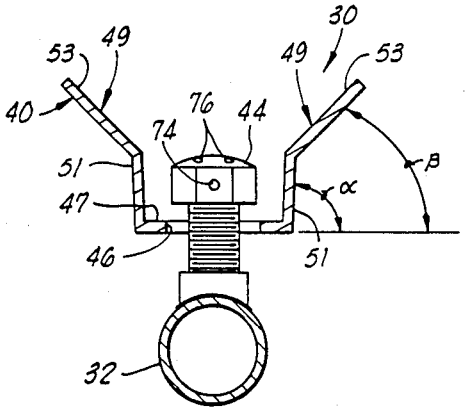
FIG. 5 is a cross-sectional view taken along line 5—5 of FIG. 3.
Figure 4:
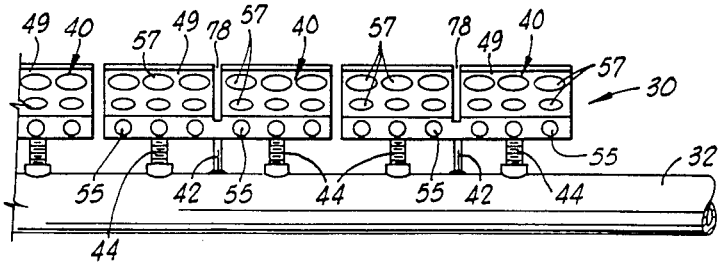
FIG. 4 is a side view taken along line 4—4 of FIG. 3.

Referring now to FIGS. 3–5, a portion of one of the burners 30 is illustrated in detail. The following description of the burners 30 and their operation applies equally to the ignition burner 50 and its operation since such burners are similar. As described above, each of the burners 30 is comprised of an elongated fuel gas supply conduit 32 positioned in the path of a flowing oxygen-containing gas stream having a plurality of perforated angular baffles 40 positioned downstream and spaced therefrom. The angular baffles 40 are supported by a plurality of spacer members 42 connected thereto and to the conduit 32. A plurality of elongated fuel gas nozzles 44 are removably connected to and spaced along the conduit 32. Each of the fuel gas nozzles 44 extends through an opening 46 in a baffle 40 whereby the fuel gas discharge end thereof is positioned within the ignition zone defined by the baffle 40.

Each of the baffles 40 includes a substantially solid flat elongated inner wall portion 47 positioned on a line parallel to the axis of the conduit 32 and lying in a plane substantially perpendicular to the direction of flow of the oxygen-containing gas stream. Attached to the sides of the inner wall portion 47 of each plurality of openings therein for the passage of oxygen-containing gas therethrough.

The diverging wing portions 49 of the baffles 40 are preferably each formed of inner leg portions 51 and outer leg portions 53 angularly connected together. The angle $\alpha$ (FIG. 5) between the plane of the inner wall portions 47 of the baffles 40 and the inner legs 51 of the wing portions 49 thereof is preferably an angle in the range of from about 0° to about 105°. The angle $\beta$ (FIG. 5) between the plane of the inner wall portions 47 and the outer legs 53 is preferably in the range of from about 0° to about 105°. Both of the inner and outer legs 51 and 53 of each of the leg portions 49 of the baffles 40 include openings for allowing oxygen-containing gas to flow therethrough into the combustion zone defined by the baffles 40 downstream thereof. More specifically, the inner legs 51 each include a plurality of openings 55 and formed therein the outer legs 53 include a plurality of openings 57 formed therein. The particular number and sizes of the openings 55 and 57 in the baffles 40 can vary depending upon various design factors, but generally such openings comprise in the range of from about 5 to 60 percent of the total surface are of the wing portions 49 prior to forming the openings 55 and 57 therein.

Figure 6:
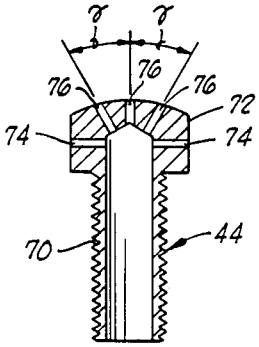
FIG. 6 is an enlarged side cross-sectional view of one of the fuel gas nozzles of the present invention.
Figure 7:
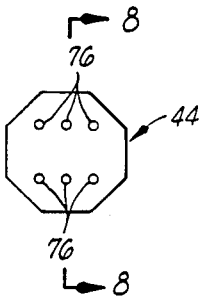
FIG. 7 is a top view of the fuel gas nozzle of FIG. 6.

Referring now to FIGS. 6, 7 and 8, one of the fuel gas nozzles 44 is illustrated in detail. Each of the nozzles 44 includes an elongated threaded conduit portion 70 connected to a hex-head portion 72 containing a plurality of fuel gas discharge ports. The fuel gas discharge ports are comprised of a pair of oppositely facing ignition ports 74 positioned to direct fuel gas at desired angles adjacent the inner wall portion 47 of the baffles 40, and a plurality of firing ports 76 for discharging fuel gas into the ignition zone defined by the baffle 40 and downstream thereof. Preferably, the firing ports include one or more center ports 76 positioned to direct fuel gas in a direction substantially perpendicular to the plane of the inner wall portions 47 of the baffles 40 (substantially parallel to the direction of flow of the oxygen-containing gas stream) with one more outer ports 76 positioned on opposite sides of the one or more center ports to direct fuel gas in diverging directions approximately parallel to the diverging wing portions 49 of the baffles 40. Preferably, the outer firing port or ports 76 are positioned at an angle $\gamma$ (FIG. 6) with respect to the center port or ports 76 in the range of from about 5° to about 75°. The ports 76 on opposite sides of the nozzle 44 are preferably positioned at an angle $\theta$ (FIG. 8) with respect to each other in the range of from about 10° to about 150°.

In operation of the burners 30, the fuel gas discharged from the ignition ports 74 of the fuel gas nozzles 44 adjacent the inner wall portions 47 of the baffles 40 mixes with oxygen-containing gases flowing through the openings 55 in the inner leg portions 51 of the wing portions 49 and from other sources. The resulting mixture burns adjacent the nozzle 44 and provides continuous ignition to the fuel gas discharged from the firing ports 76. The fuel gas discharged from the firing ports 76 mixes with additional oxygen-containing gases flowing into the ignition zone defined by the baffles 40 and flowing past such zone, and the mixture is ignited and burned within and downstream of the zone.

As will now be understood by those skilled in the art, the inner wall portions 47 of the baffles 40 provide a protected relatively quiescent zone downstream thereof adjacent the discharge port ends of the nozzles 44 in which an ignition gas mixture is formed and continuously burned. In addition, the inner wall portions 47 of the baffles 40 shield the fuel gas supply conduits 32 from heat radiation and flame impingement whereby uneven heating of the conduits is substantially prevented. A plurality of the baffles 40 are utilized with each conduit 32, and the baffles 40 each include slots 78 (FIGS. 3 and 4) in the outer leg portions 53 thereof to minimize stresses in the baffles and the warping thereof.

As a result of the elimination of uneven heating of the conduits 32, the formation of hot spots and deposits of coked fuel on and within the conduits is eliminated. In some applications, this improvement is of major economic significance as a result of decreased maintenance.

Because the fuel gas nozzles 44 are individually removable from the burners 30, they can be easily changed and/or cleaned in the field. Further, the nozzles each include a plurality of carefully sized and positioned firing ports 76. The use of such fuel gas nozzles in combination with the improved baffles 40 cause the burners 30 to provide better combustion of the fuel gas, to produce short flame lengths, to have high turn down capability and to more evenly distribute heat into the gas stream being heated. As a result of the better combustion, the burners and burner assemblies of this invention produce lower emissions of atmosphere polluting compounds.

Thus, the present invention is well adapted to carry out the objects and attain the ends and advantages mentioned as well as those inherent herein. While presently preferred embodiments of the invention have been described herein for purposes of disclosure, numerous changes in the construction and arrangement of parts can be made by those skilled in the art, which changes are encompassed within the spirit of this invention as defined by the appended claims.

What is claimed is:

1. Apparatus for burning a gaseous fuel in the presence of a flowing oxygen-containing gas stream comprising:

fuel gas supply conduit means positioned in the path of said oxygen-containing gas stream;

at least one elongated baffle means including a substantially solid inner wall portion and outer wing portions spaced from said conduit means on the downstream side thereof defining a gas ignition zone which is shielded from said conduit means, the wing portions of said baffle means having openings therein for the passage of oxygen-containing gas into said ignition zone;

spacer means for supporting said baffle means connected between said baffle means and said conduit means; and at least one elongated fuel gas nozzle means threadedly connected to said fuel gas supply conduit means and extending through an opening in said inner wall portion of said baffle means for introducing fuel gas into said ignition zone.

2. The apparatus of claim 1 wherein said fuel gas nozzle means includes a plurality of fuel gas discharge ports, at least one of which is positioned to direct fuel gas adjacent said inner wall portion of said baffle means.

3. The apparatus of claim 2 wherein said fuel gas supply conduit means comprises an elongated conduit positioned transversely to the direction of flow of said oxygen-containing gas stream and said elongated baffle means are positioned on a line substantially parallel to the axis of said conduit.

4. The apparatus of claim 3 wherein said fuel gas nozzle means are comprised of a plurality of elongated fuel gas nozzles threadedly connected to and spaced along said conduit, each of which extends through an opening in said inner wall portion of said baffle means.

5. Apparatus for burning a gaseous fuel within a duct having an oxygen-containing gas stream flowing therethrough comprising:

a housing adapted to be sealingly connected to said duct whereby said oxygen-containing gas stream flows therethrough;

at least one elongated fuel gas supply conduit positioned within said housing transversely to the direction of flow of said oxygen-containing gas stream;

at least one elongated angular baffle means spaced from said conduit on the downstream side thereof defining a gas ignition zone which is shielded by said baffle means from said conduit, said baffle means including a substantially solid inner wall portion and a pair of outer wing portions attached thereto having openings therein for the passage of oxygen-containing gas into said ignition zone;

spacer means for supporting said baffle means connected between said baffle means and said conduit; and at least one elongated fuel gas nozzle threadedly connected to said fuel gas supply conduit and extending through an opening in said inner wall portion of said baffle means for introducing fuel gas into said ignition zone.

6. The apparatus of claim 5 wherein said fuel gas nozzle means includes a plurality of fuel gas discharge ports at least one of which is positioned to direct fuel gas adjacent said inner wall portion of said baffle means.

7. The apparatus of claim 6 wherein said fuel gas supply conduit means comprises an elongated conduit positioned transversely to the direction of flow of said oxygen-containing gas stream and said elongated baffle means are positioned on a line substantially parallel to the axis of said conduit.

8. The apparatus of claim 7 wherein said fuel gas nozzle means are comprised of a plurality of elongated fuel gas nozzles threadedly connected to and spaced along said conduit, each of which extends through an opening in said inner wall portion of said baffle means.

9. Apparatus for burning a gaseous fuel within a duct having an oxygen-containing gas stream flowing therethrough comprising:

a housing adapted to be sealingly connected to said duct whereby said oxygen-containing gas stream flows therethrough;

a plurality of elongated fuel gas supply conduits positioned within said housing transversely to the direction of flow of said oxygen-containing gas stream;

a plurality of elongated angular baffle means, each being spaced from one of said conduits on the downstream side thereof and defining a gas ignition zone which is shielded from said conduit, said baffle means including a substantially solid inner wall portion and a pair of diverting outer wing portions including a plurality of openings therein for the passage of oxygen-containing gas into said ignition zone;

a plurality of spacer means for supporting each of said angular baffle means connected between said baffle means and said conduits; and fuel gas nozzle means connected to each of said conduits comprised of a plurality of elongated fuel gas nozzles threadedly connected to and spaced along said conduits, each of such nozzles extending through an opening in the inner wall portion of said baffle means.

10. The apparatus as defined in claim 9 wherein each of said fuel gas nozzles includes a plurality of fuel gas discharge ports with at least one of said ports positioned to direct fuel gas adjacent said inner wall portion of said baffle means.

11. The apparatus of claim 10 wherein all but one of said elongated conduits are positioned whereby they are substantially parallel to each other and the axes thereof lie in a single plane substantially perpendicular to the direction of flow of said oxygen-containing gas stream, and the other conduit is positioned transversely to the direction of flow of said oxygen-containing gas stream and lying outside of said plane.

12. The apparatus of claim 11 wherein said other conduit includes means for igniting fuel attached thereto.

13. In a method of burning a gaseous fuel in the presence of a flowing oxygen-containing gas stream utilizing at least one fuel gas discharge nozzle means connected to fuel gas supply conduit means positioned in the path of said oxygen-containing gas stream, the improvement whereby uneven heating of the fuel gas supply conduit means and the resultant formation of coke deposits and hot spots thereon is substantially eliminated comprising the steps of:

providing at least one elongated baffle means having a substantially solid inner wall portion and outer wing portions downstream of said fuel gas supply conduit means whereby said baffle means shields said conduit means from heat radiation and flame impingement; and positioning said discharge nozzle means to discharge fuel gas on the opposite side of said baffle means from said conduit means, said fuel gas discharge nozzle means being comprised of at least one elongated fuel gas nozzle threadedly connected to said fuel gas supply conduit means and extending through an opening in said inner wall portion of said baffle means.

14. The method of claim 13 wherein said fuel gas discharge nozzle means includes a plurality of fuel gas discharge ports, at least one of which is positioned to direct fuel gas adjacent said inner wall portion of said baffle means.

15. The method of claim 14 wherein said fuel gas supply conduit means comprises an elongated conduit positioned transversely to the direction of flow of said oxygen-containing gas stream and said elongated baffle means are positioned on a line substantially parallel to the axis of said conduit.

16. The method of claim 15 wherein said fuel gas discharge nozzle means are comprised of a plurality of elongated fuel gas nozzles threadedly connected to and spaced along said conduit, each of which extends through an opening in said inner wall portion of said baffle means.

* * * * *

UNITED STATES PATENT AND TRADEMARK OFFICE

CERTIFICATE OF CORRECTION

PATENT NO. : 4,737,100

DATED : April 12, 1988

INVENTOR(S) : Earl W. Schnell et al.

It is certified that error appears in the above-identified patent and that said Letters Patent are hereby corrected as shown below:

Column 1, line 30, between "in" and "waste" insert --a--;
Column 2, line 7, change "with" to --which--;
Column 4, line 13, change "baffler" to --baffle--;
Column 4, line 57, change "60" to --50--; and
Column 8, line 10, change "diverting" to --diverging--.

Signed and Sealed this

Sixteenth Day of August, 1988

*Attest:*

DONALD J. QUIGG

*Attesting Officer*

*Commissioner of Patents and Trademarks*